United States Patent [19]

Kramer

[11] Patent Number: 4,572,241

[45] Date of Patent: Feb. 25, 1986

[54] LENO HEDDLE DEVICE

[75] Inventor: Charles F. Kramer, Greenville, S.C.

[73] Assignee: Steel Heddle Manufacturing Co., Greenville, S.C.

[21] Appl. No.: 673,266

[22] Filed: Nov. 20, 1984

Related U.S. Application Data

[63] Continuation of Ser. No. 428,190, Sep. 29, 1982, abandoned.

[51] Int. Cl.[3] ..... D03C 7/02

[52] U.S. Cl. ..... 139/52

[58] Field of Search ..... 139/51, 52, 96

[56] References Cited

U.S. PATENT DOCUMENTS 1,037,151 8/1912 Kaufmann ..... 139/52

3,058,495 10/1962 Kaufmann ..... 139/51

3,990,481 11/1976 Graf ..... 139/52

*Primary Examiner*—Henry S. Jaudon

*Attorney, Agent, or Firm*—Julian W. Dority

[57] ABSTRACT

Lifting heddles A and B are disclosed as including interfitting heddle elements C and D of which C is a female heddle element and D is a male heddle element. C-shaped rod slots E and F are formed in the ends of heddle element D. Slots E, E' are formed in the ends of female heddle element C. Slot E' includes an extended upper slot portion 86 which receives a reduced neck 98 of the shank 40 of male heddle element D. A shoulder 100 of the male heddle element interfits with a ledge 92 of slot E' of the female heddle element. Interfitting slots E' and F form a resultant C-shaped slot which corresponds in shape to opposing juxtaposed end slots E and F providing mobility of the lifting heddles A and B on the heddle frame avoiding sectionalization thereof.

2 Claims, 7 Drawing Figures

LENO HEDDLE DEVICE

BACKGROUND OF THE INVENTION

This is a continuation of application Ser. No. 06/428,190 (now abandoned) entitled LENO HEDDLE DEVICE filed on Sept. 29, 1982.

The invention relates to a leno heddle device for a leno or doup heddle frame of a loom. Typically, such a heddle device includes a pair of lifting heddles which are interconnected at a medial portion by a doup heddle. The end includes a rod slot for connection to a heddle support rod. The rod slot is customarily formed in an O-shape. In some cases, the lifting heddle included two heddles fitted together. In this case, the rod slot of one of the heddles is enlarged relative to the other and receives a reduced neck of the other heddle in an interlocking manner. A heddle rod is slidably received in the rod slots by which the leno heddle devices are carried on the heddle frame.

The problem exists that the O-shaped rod slots of the prior leno heddles limit the mobility of the heddles on the heddle frame due to the presence of slide hooks which connect the heddle rods to the frame slat on the heddle frame. Due to the closed shape of the O-shaped slot, the heddle devices cannot slide past the slide hook. The heddle devices cannot be moved readily to and fro across the frame and thus become sectionalized on the heddle frame. This creates excessive numbers of heddle devices in certain sections of the heddle frame. This is particularly a problem when using leno heddles on a full width leno frame where up to 500 leno heddles may be carried. More heddles are present than are needed to guide the warp yarn ends in that section of the frame between slide hooks. The loom attendants are reluctant to perform the work required to redistribute heddles and space the used heddles evenly on the frame. Uneven spacing of the warp yarns results in the sections on the heddle frame creating gaps between the individual warp yarn ends which can create streaks in the fabric.

Leno heddle pairs having C-shaped end portions encompassing a slot have been proposed. While technically it is the end portions of the heddles that are C-shaped and O-shaped, it has become customary in the industry to refer to the heddles as having C-shaped slots and O-shaped slots. The open areas of the slot slides past the supporting member on the frame whereby the heddles evenly space themselves on the frame during use. The prior heddle pairs with C-shaped rod slots have been spot welded for interconnection. Separate C-shaped rod slot pieces are spot welded at a medial portion between the opposing ends and opposing rod hook slots. This requires a much more lengthy and costly process for constructing the heddle devices.

Accordingly, an important object of the present invention is to provide a leno heddle device which provides infinite mobility of the lifting heddles on a heddle frame so that the heddles space themselves evenly across the width of the heddle frame eliminating sectionalizing of the heddles.

Still another important object of the present invention is to provide a leno heddle device having interfitting heddle elements with interlocking C-shaped end portions.

Yet another object of the present invention is to provide lifting heddles for a leno or doup heddle frame wherein a C-shaped rod slot is provided in one end of a female heddle element which includes an extended slot opening in which a reduced neck of a shank of a male heddle element is received for interconnecting the heddle elements in a lifting heddle.

SUMMARY OF THE INVENTION

The above objectives are accomplished according to the present invention by means of a lifting heddle having a pair of interfitting heddle elements. Each heddle element includes a C-shaped end portions at the ends thereof which provides infinite mobility across the heddle rod of the heddle frame. One of the C-shaped end portions in one of the heddle elements has a female slot having an extended slot portion for receiving a neck of the male heddle element which is interlocked therein.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The invention relates to a heddle device for a leno heddle frame or a doup frame in which lifting heddles A and B of interfitted heddles C and D are provided having C-shaped end portions. Since the construction and use of conventional leno and doup heddles and frames as used on conventional looms are well known in the art, only so much of a heddle frame as is necessary to an understanding of the invention will be illustrated herein.

Figure 1:
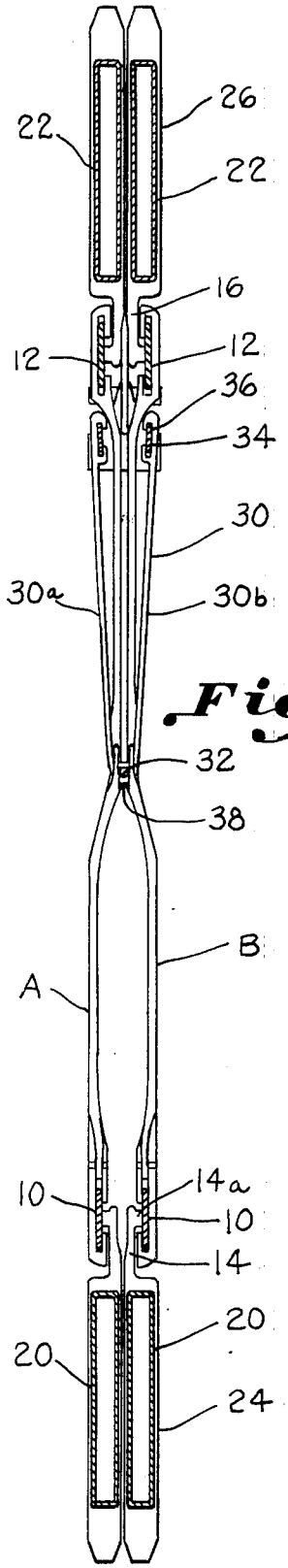
FIG. 1 is a side elevation illustrating a pair of lifting heddles carried by a heddle frame in section according to the invention.
Figure 2:
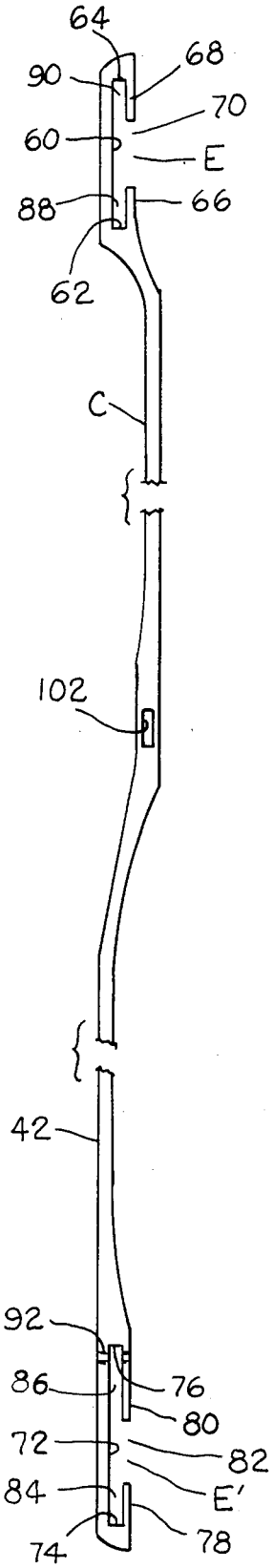
FIG. 2 is a side elevation illustrating a first female heddle of a heddle lifting pair according to the invention.
Figure 3:
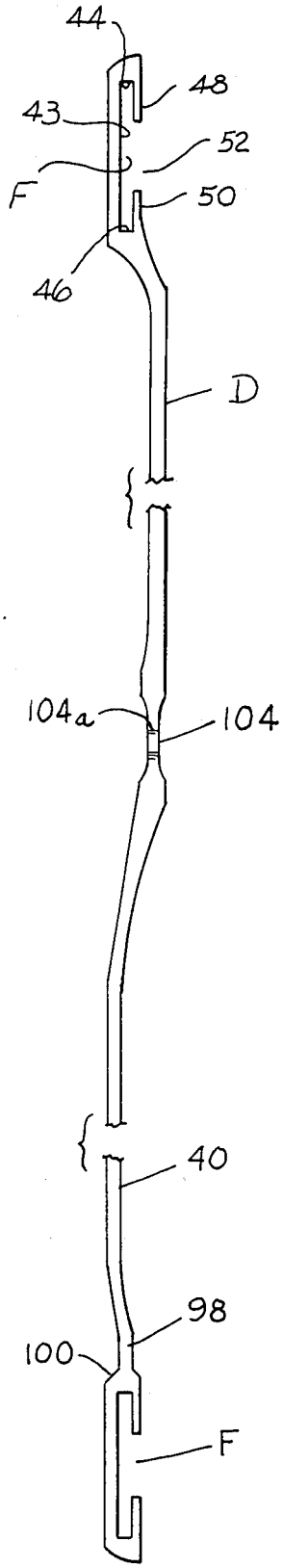
FIG. 3 is a side elevation of a second male heddle of a lifting heddle pair according to the invention.
Figure 4:
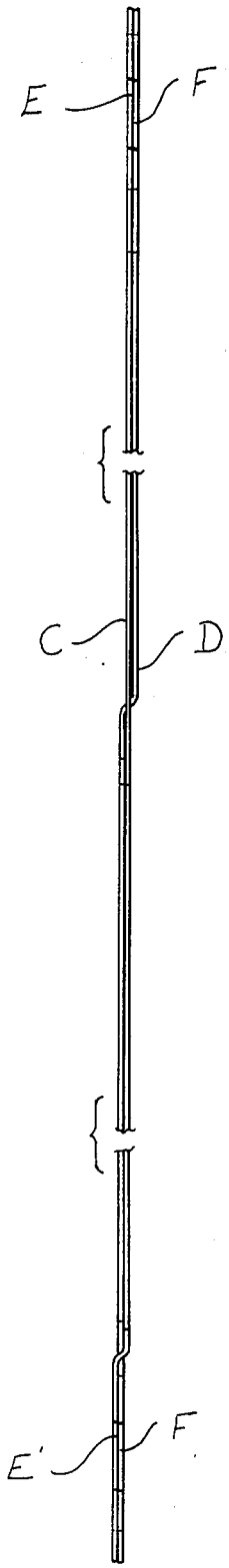
FIG. 4 is a front elevation of a lifting heddle according to the invention having C-shaped interlocking end portions.
Figure 7:
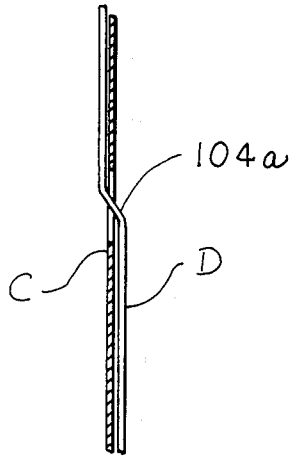
FIG. 7 is an enlarged partial sectional view of the interlocking medial portion of the lifting heddle of FIG. 4.

Accordingly, FIG. 1 illustrates lifting heddles A and B carried between a pair of heddle rods 10 and 12 of a heddle frame unit. The heddle rods are carried by means of heddle rod support flanges 14 and 16 which are carried on the lower frame slats 20 and upper frame slats 22 of a conventional frame unit. The heddle rod supporting flanges 14 and 16 are typically an integral structure of lower and upper holder devices 24 and 26 which surround frame slats 20 and 22 in the form of a sleeve.

A conventional doup heddle 30 is carried by the lifting heddles A and B having an eye 32 through which a doup warp yarn end is threaded and guided on the loom. The lifting heddles A and B lift the doup heddle 30 in a conventional manner such as disclosed in U.S. Pat. Nos. 3,058,495 and 1,037,151. By this means, the warp end is raised and lowered to form a shed for weaving. The doup heddle 30 includes a pair of slots 34 which fit on rods 36 on the frame unit in a conventional manner. The heddles include legs 30*a* and 30*b* which extend from the rod slot to a bridge 38 where the eye 32 is formed.

Each lifting heddle A and B includes a first female heddle element C and a second male heddle element D. Each heddle element includes a generally C-shaped end portion formed on opposing ends of the heddle for receiving the heddle rod 10, 12, and a shank 40 and 42 extending between the slot portions.

The second male heddle element D includes a C-shaped end portion F on each end thereof which is defined by a web 43, opposing end portions 44 and 46 terminating and extending from the web 43 and a pair of opposing fingers 48 and 50 which extend towards one another and terminate short to define a gap 52 which is open such that it may ride over a connecting ridge 14*a* which is connected to the back side of the heddle rod.

Likewise, the first female heddle element C includes a C-shaped end portion E at one end thereof and a C-shaped end portion E′ at the opposing end thereof which include differing shaped slots as will be more fully described herein. The end portion E includes a web 60, a pair of end portions 62 and 64, and a pair of fingers 66 and 68 which define an open area or gap 70. The opposing C-shaped end portion E′ includes a web 72, a pair of end portions 74 and 76 and a pair of fingers 78 and 80 defining a gap 82.

It will be noted that each of the above described C-shaped end portions include upper and lower slot portions which are defined on either side of the above described gap by the respective web, end portions, and fingers thereof.

Figure 6:
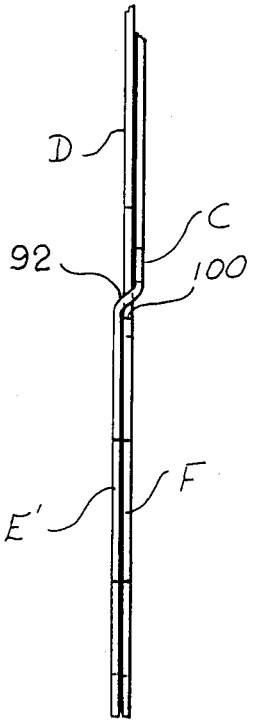
FIG. 6 is an enlarged partial front view of the heddle of FIG. 4.

The end portion E′ includes lower slot portion 84 and upper slot portion 86 so defined. It will be noted that the finger 80 of the C-shaped end portion E′ is considerably longer than the finger 66 of the corresponding end portion on the opposing end. The elongated finger 80, together with end portion 76 and web 72 defines an extended upper slot which has a depth considerably greater than the depth of corresponding lower slot portion 88 of slot E. Upper slot portion 86 of slot E′ also includes a ledge 92 defined by a laterally offset bend in an area of the extended lower slot 86. The ledge 92 can best be seen in FIG. 6 as including the steel strip of heddle element C being bent laterally and horizontally to the left.

Shank 40 of the male heddle element D includes a relatively straight reduced neck 98 adjacent the C-shaped end portion F which is reduced in width compared to the remainder of the shank. The neck terminates at a shoulder 100 of the end member. The reduced neck 98 fits within the lower extended slot portion 86 of the C-shaped end member E′ of the female heddle element C such that the shoulder 100 nests alongside the ledge 92. Female heddle element C includes a medial opening 102 in which a reduced medial portion 104 of the male element fits. For this purpose, and so that the interlaced heddle pair may remain flat, the reduced portion 104 of the male heddle is also laterally offset and bent.

To interfit heddle elements C and D together, an end of element D is inserted in opening 102, until offset ledge 104 is fitted against the upper edge of the opening. The lower shank 42 of element C is then bowed and the reduced neck 98 of element D is received in extended slot portion 86.

Figure 5:
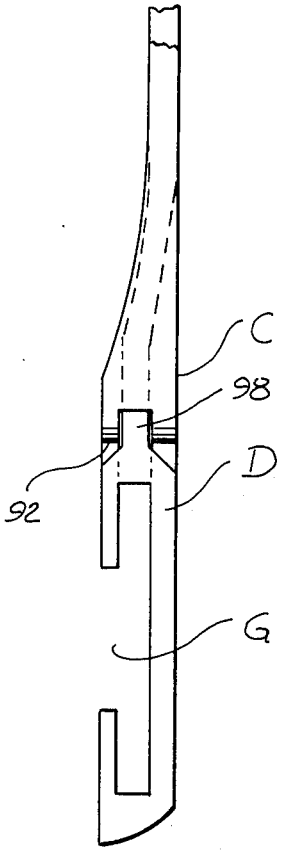
FIG. 5 is an enlarged partial elevation illustrating a lifting heddle having interlocking C-shaped end portions according to the invention.

It will be noted from FIG. 5 that the resultant C-shaped end portion G defined by the C-shaped end portions F and E′ of the respective male and female heddle elements fitted together is of generally the same shape as the C-shaped end portions E and F on the opposite ends of the male and female heddle elements. This provides for general uniformity in the fit and wear of the lifting heddle on the heddle rod and disposition in the heddle frame.

The above described heddle elements C and D are cut or stamped out of a hardened and tempered high carbon material such as AISI NC-1070 wire which has been hardened by heat treatment. This has been found to provide more life through improved wearing characteristics and added strength around the above described cut-out areas of the C-shaped end portion which facilitate the use of such an open slot in a leno or doup heddle frame. While only one end has been shown interlocking, it is to be understood that both ends may be provided with interlocking structure.

Thus, it can be seen that an advantageous construction for lifting heddles for a leno or doup frame can be had according to the present invention where the heddles have increased mobility across the width of the frame reducing sectionalization of the frame which creates gaps and streaks in the warp yarns.

It is to be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit or scope of the invention herein disclosed.

What is claimed is:

1. A lifting heddle for a loom comprising:

a first heddle element;

a second heddle element interfitted with said first heddle element;

each said heddle element including a C-shaped end member on opposing ends thereof defining a heddle rod slot for receiving a heddle rod and a shank extending between said C-shaped end members;

said C-shaped end member being defined by a back web, closed end portions terminating said web and extending outwardly therefrom, opposed fingers extending from said end portions towards one another terminating short of one another to define an open gap area;

said gap area being open sufficiently to enable said heddle to slide past a heddle rod connecting members when said heddle rod is received in said slot;

said rod slot including upper and lower slot portions defined on either side of said gap area;

a first of said C-shaped end members on one end of said first heddle element having one of said fingers thereof being longer than the other said finger, said one finger, said back web, and said end portion thereof defining an extended upper slot portion having a greater depth than the depth of said lower slot portion of said first C-shaped end member;

said one finger and said back web of said first heddle element including a laterally offset bend in an area of said extended upper slot portion of said first C-shaped end member defining a ledge;

said shank of said second heddle element including a neck of reduced width adjacent the lower C-shaped end portion;

a shoulder formed by an upper surface of said lower C-shaped end member of said second heddle element;

said slot of said second heddle element generally aligning with said slot of said first element with said shoulder of said second heddle element nesting alongside said ledge of said first heddle element;

said first heddle element including a medial opening formed in said shank for receiving said second heddle element therethrough;

said neck of said second heddle element fitting within said extended upper slot portion of said slot of said first heddle element whereby said first second and first heddle elements are fitted together as a lifting heddle, and said heddle elements being stamped from high carbon steel into their final shape.

2. The heddle of claim 1 wherein said heddle elements are formed from a hardened high carbon material hardened by heat treatment.

* * * * *